US006073795A

United States Patent [19]

Longstreth

[11] Patent Number: 6,073,795

[45] **Date of Patent: *Jun. 13, 2000**

[54] SALAD BOWL WITH A LID

[75] Inventor: James R. Longstreth, Whittier, Calif.

[73] Assignee: Winkler Forming, Inc., Santa Fe Springs, Calif.

[ * ] Notice: This patent is subject to a terminal disclaimer.

[21] Appl. No.: 08/788,513

[22] Filed: Jan. 24, 1997

Related U.S. Application Data

[63] Continuation-in-part of application No. 29/052,647, Apr. 4, 1996.

[51] Int. Cl.[7] ..... B65D 8/04

[52] U.S. Cl. ..... 220/574; 220/669; 220/756; 220/DIG. 13

[58] Field of Search ..... 220/669, 574, 220/756, 576, 2, DIG. 13

[56] References Cited

U.S. PATENT DOCUMENTS

| | | | |
|---|---|---|---|
| D. 131,150 | 1/1942 | Swofford . | |
| D. 194,434 | 1/1963 | Whitman et al. | 220/669 |
| D. 381,563 | 7/1997 | Longstreth . | |
| D. 392,159 | 3/1998 | Longstreth . | |
| 528,072 | 10/1894 | Weiss et al. | 220/2 |
| 933,881 | 9/1909 | Brown | 220/756 |
| 1,507,685 | 9/1924 | Robinson | 220/2 |
| 1,696,099 | 12/1928 | McGranigham . | |
| 1,974,898 | 9/1934 | Rutledge . | |
| 2,170,040 | 8/1939 | Stuart . | |
| 2,179,188 | 11/1939 | Kitselman | 220/574 |
| 2,283,704 | 5/1942 | Staudal . | |
| 2,811,152 | 10/1957 | Wicks . | |
| 3,037,677 | 6/1962 | Debs . | |
| 3,474,929 | 10/1969 | Harker | 220/756 |
| 3,598,278 | 8/1971 | Vann . | |
| 3,625,305 | 12/1971 | Mueller et al. | 220/669 |
| 3,737,068 | 6/1973 | Bird . | |
| 4,157,762 | 6/1979 | Robinson | 220/669 |
| 4,197,940 | 4/1980 | DeRossett . | |
| 4,202,464 | 5/1980 | Mohs et al. . | |
| 4,705,163 | 11/1987 | James . | |
| 4,874,083 | 10/1989 | Antoni et al. . | |
| 4,901,858 | 2/1990 | Anderson . | |
| 4,909,392 | 3/1990 | Williams et al. | 220/756 |
| 4,930,627 | 6/1990 | Borst et al. . | |
| 4,961,494 | 10/1990 | Alexander . | |
| 4,962,849 | 10/1990 | Anderson . | |
| 5,011,006 | 4/1991 | Anderson . | |
| 5,169,023 | 12/1992 | Heiberg et al. | 220/574 |
| 5,375,701 | 12/1994 | Hustad et al. . | |
| 5,390,816 | 2/1995 | Boyd . | |
| 5,542,565 | 8/1996 | Hidalgo-Lopez | 220/576 |
| 5,657,873 | 8/1997 | Hustad et al. . | |
| 5,657,874 | 8/1997 | Hustad et al. . | |
| 5,695,798 | 12/1997 | Rozzano . | |

FOREIGN PATENT DOCUMENTS

WO 98/32665 7/1998 WIPO .

OTHER PUBLICATIONS

International Search Report, International Application No. PCT/US98/00908, International Filing Date Jan. 23, 1998.

*Primary Examiner*—Joseph M. Moy
*Attorney, Agent, or Firm*—Leydig, Voit & Mayer, Ltd

[57] ABSTRACT

A salad bowl made of a plastic moldable material having a platform adjacent one side of the bowl to permit the bowl to rest on the platform so that the bowl may be maintained in an upright position. In the preferred embodiment of the invention, a cover is capable of fitting over the top of the bowl for maintaining the contents of the bowl in place when the bowl is positioned in its upright position.

8 Claims, 5 Drawing Sheets

SALAD BOWL WITH A LID

RELATED APPLICATIONS

This application is a Continuation-in-Part of application Ser. No. 29/052,647, filed on Apr. 4, 1996, incorporated herein by reference. Now U.S. Pat. No. Des, 381,563.

BACKGROUND OF THE INVENTION

1. Field of the Invention

The present invention relates to a food container such as a salad bowl, and in particular to a container that may be stored on a store shelf in an upright manner so as to readily display the container contents to a store customer.

2. Description of the Related Art

There have been a number of salad bowls made of plastic moldable materials, such as PVC or PET, which are used for holding food products. The bowls typically have a cylindrical configuration with a generally circular cover that fits over the top of the bowl for maintaining the contents of the bowl from falling out. The cover can be either a "snap on cover", one that can be reused if desired, or a sealed cover, one that is adhered to the top edge of the bowl by suitable means, such as adhesive or heat, and which cannot be reused.

For the purposes of display in stores, if the bowls are placed on the shelves of the store in their conventional manner, i.e., one on top of the other, then the contents of the bowls are not readily observable by someone walking down the aisles of the store. It is well known by those in the grocery trade that the more visible the product, the more likely it is that the consumer will buy the product. It would be advantageous therefore, to have a bowl that may be stackable one upon the other for purposes of shipment or storage while capable of being displayed in a stable upright position when placed on store shelves for sale.

SUMMARY OF THE INVENTION

In accordance with the present invention a conventional bowl or container may be stored on its side in an upright position so that the contents of the bowl will be facing the customer as the customer walks down the aisle of the store. This is achieved by having a foot or platform portion of the molded bowl arranged so as to provide stable footing for the bowl placed in the upright position. More specifically, the foot consists of a segment of the bowl that extends from the side wall of the bowl in a rearward and downward direction, terminating in a flat surface portion that is substantially in alignment with the top surface of the bowl. The top surface or peripheral edge of the bowl therefore forms one point of contact with the store shelf, and the flat surface of the foot forms a second point of contact with the store shelf, maintaining the bowl in an upright orientation.

In the preferred embodiment of the invention, a removable cover is interlockably attached to the bowl and may be repeatedly attached and removed from the bowl. The cover removably attaches to the top edge of the bowl in any number of well known manners.

OBJECTS OF THE INVENTION

It is an object of the present invention to provide a bowl that can be set on its side and maintained in an upright orientation;

It is a further object of the invention to provide a bowl that can be easily made in one piece of plastic material.

These and other objects of the invention will be apparent from a review of the accompanying specification and drawings.

DETAILED DESCRIPTION OF THE INVENTION

Figure 1:
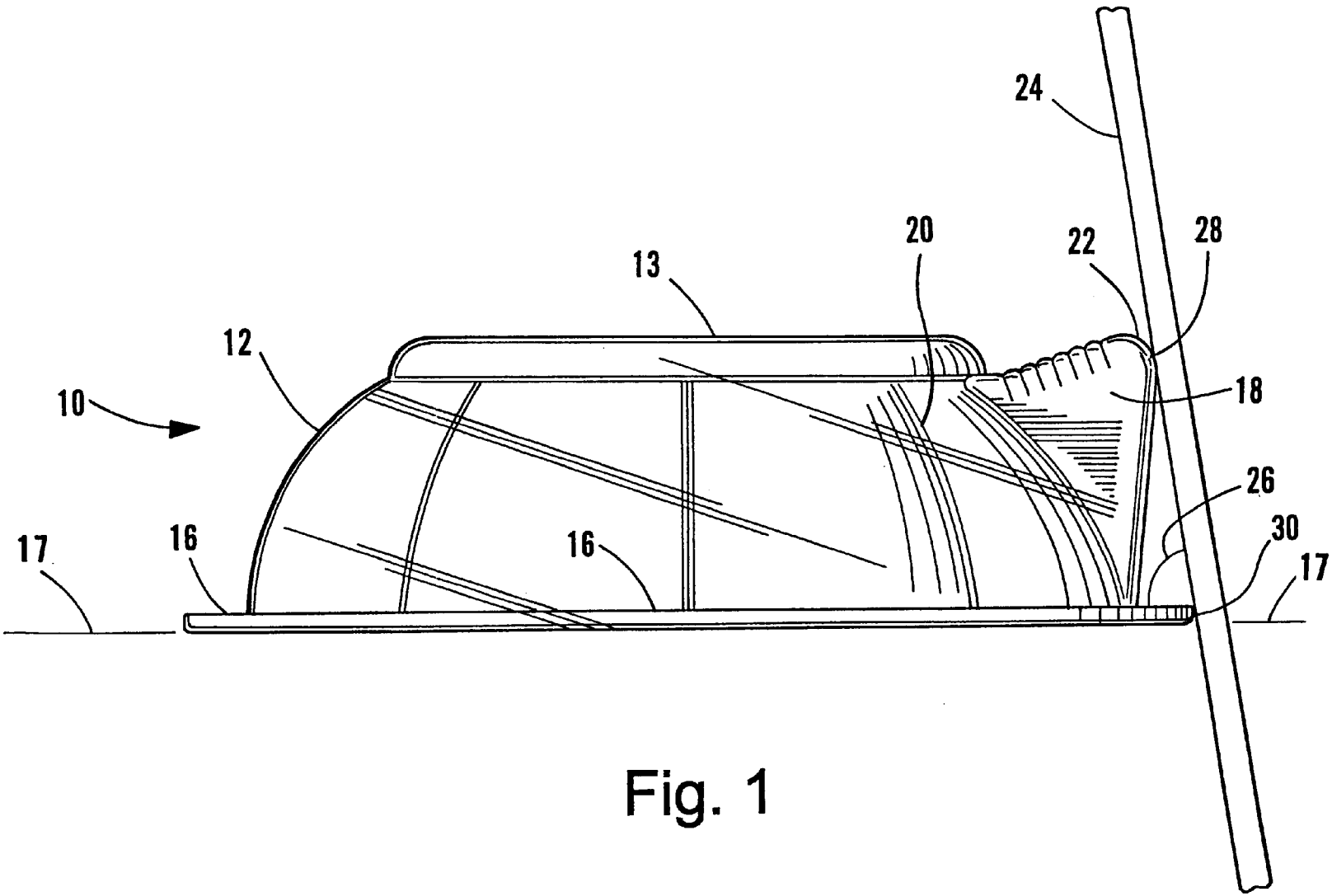
FIG. 1 is a perspective view of the bowl of the present invention resting, in the upright position, on a horizontal surface.
Figure 2:
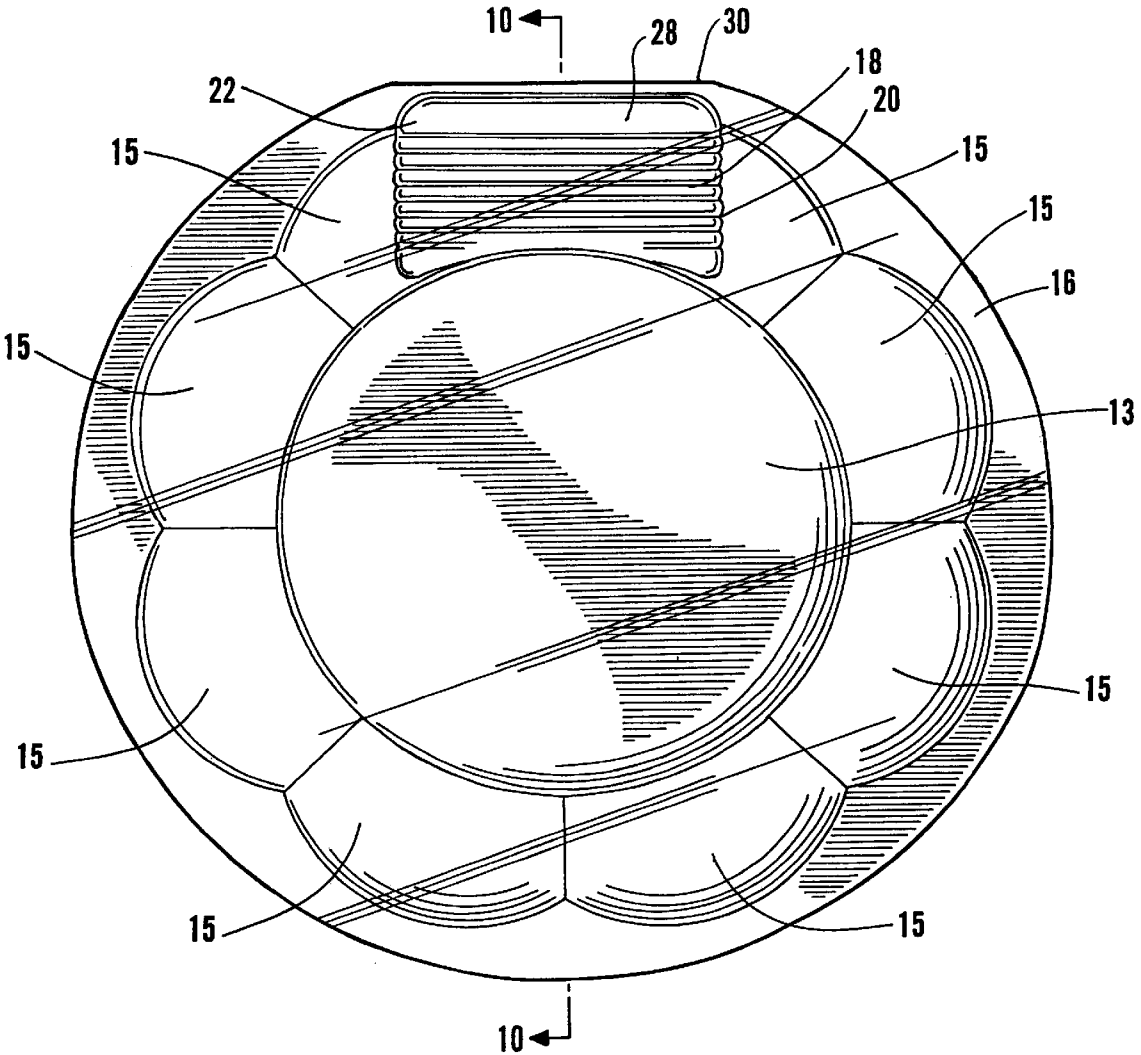
FIG. 2 is a bottom view of the bowl of the present invention.
Figure 3:
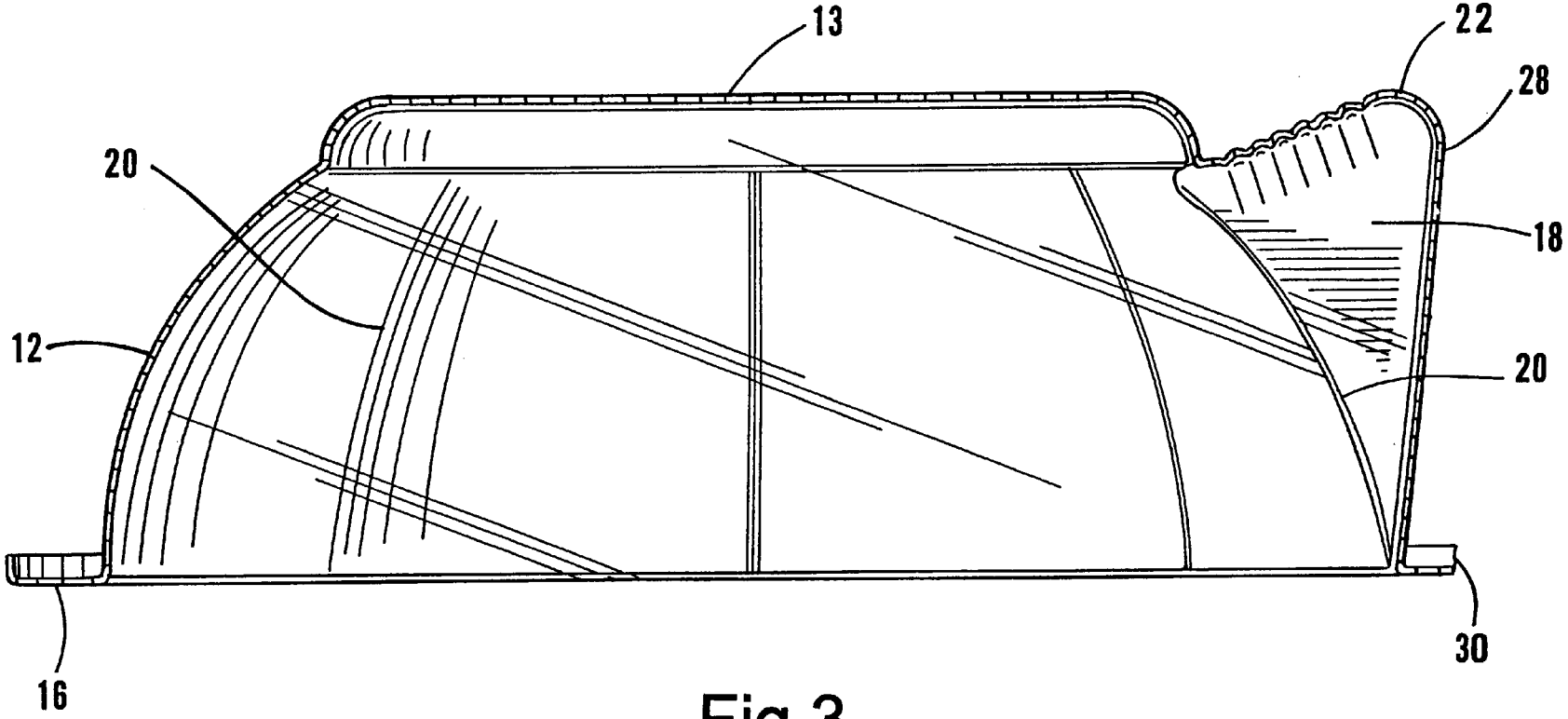
FIG. 3 is a side elevation view of the bowl of the present invention.

Referring now to the drawings and in particular to FIGS. 1, 2 and 3, the two piece food container is shown and generally referenced by the numeral 10. Container 10, which may be constructed of any one of a number of clear resilient plastic materials known in the art, consists of a bowl portion 12 having a flat planar base 13, sidewalls 20 and an upper peripheral edge 16. A cover or lid portion 14 (shown in FIGS. 4 and 5) which, as will be described in further detail below, is sized and shaped to fit over upper peripheral edge 16 of the bowl portion 12 and serves, by means of an interference or press fit, to provide the bowl portion 12 with a tight seal. The flat planar base 13 is parallel to upper peripheral edge 16. Upper peripheral edge 16 is essentially circular and lies in a plane 17. When the base 13 is placed upon a horizontal surface, the container 10 rests in a horizontal position.

The interior shape of the bowl portion 12 is generally annular with decreasing annular diameters progressing from the peripheral edge 16 to the base 13. Scalloped portions 15 are phased sequentially around the bowl portion 12 to provide an overall decorative and aesthetic appeal to the container 10, as well as to provide structural rigidity. Although shown in generally annular cross-section (see FIGS. 2 and 3) it is to be understood that other shapes such as oval, scalloped, square or rectangular, are also within the contemplation of the present invention.

A platform (or foot) 18 projects outwardly and downwardly from sidewall 20 and serves to stabilize and maintain the container 10 in an upright position (as shown in FIG. 1) when both the platform 18 and upper peripheral edge 16 are placed in contact with a horizontal surface such as a store shelf. The end 22 of the platform 18 is positioned, in the preferred embodiment, so that a straight line drawn from platform end 22 to upper peripheral edge 16 (representing a horizontal surface 24 upon which the container 10 rests) forms an included angle 26 that is preferably less than 90 degrees with respect to the plane 17. Accordingly when placed on a store shelf in the upright position, the container 10 tilts slightly backwards to provide better visibility of its contents when observed by passers-by and prevent forward tipping. Preferably, the end 22 extends outward and downward to the extent such that, when the container 10 rests on a horizontal surface, on its side, angle 26 is in the range of about 70 to 80 degrees. A flat surface 28 extends the width of the platform 18 along its end 22. Peripheral edge 16 includes a flat outer surface 30 that is sized and positioned to be parallel and in registration with flat surface 28. Outer surface 30 and flat surface 28 provide two extended points of contact along a horizontal surface so as to further maintain the container 10 stable in the upright position.

Figure 4:
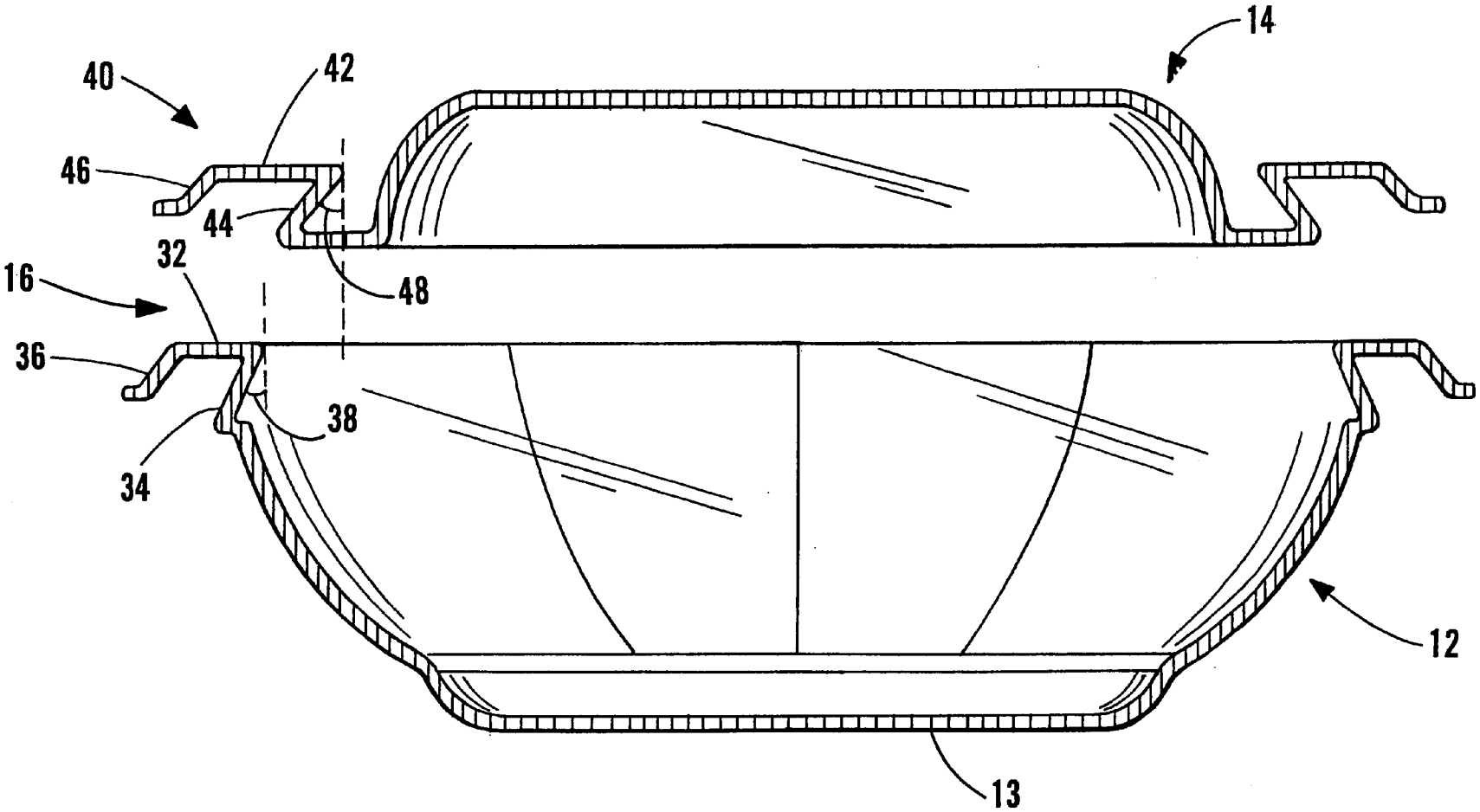
FIG. 4 is a partial cut away view of the bowl and the cover showing an interlocking arrangement between the cover and bowl of the present invention.
Figure 5:
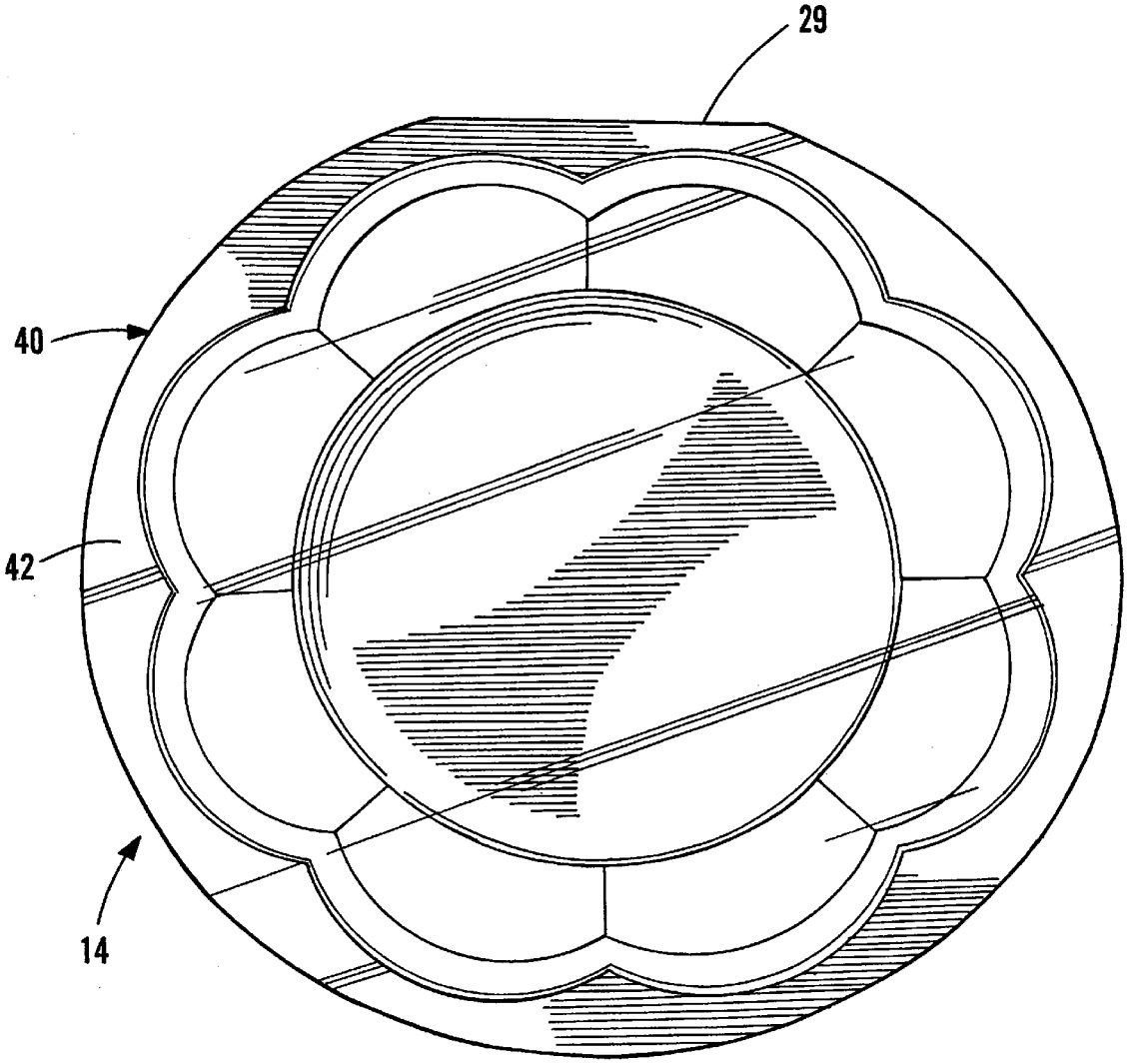
FIG. 5 is a bottom view of the lid of the bowl of the present invention.

Lid 14 shown in FIG. 4 is closeable over bowl portion 12 and is sized and shaped to fit snugly over the peripheral edge 16 so that when urged onto the peripheral 16 a press fit is maintained thereby providing a tight seal of the bowl portion 12. Lid 14 includes an edge surface 29 (FIG. 5), dimensioned and positioned to be parallel to and in registration with, bowl portion outer surface 30 when the lid 14 is closed on the bowl portion 12.

As shown in the partial cross-section of FIG. 4 peripheral edge 16 includes raised surface 32 from which depend walls 34 and 36. Wall 34 flairs away from surface 32 at acute angle 38. Similarly lid 14 includes a peripheral edge 40 that includes raised surface 42 from which depend walls 44 and 46. Wall 44 flairs away from surface 42 at acute angle 48 that is slightly greater than angle 38. In this fashion, when peripheral edge 40 is urged against peripheral edge 16 wall 44 will interfere with walls 34 to achieve a press fit therebetween. Although one embodiment has been disclosed, it is recognized that one skilled in the art may utilize alternate interlocking arrangements. For example, an adhesive may be applied to one or the other of peripheral edges 16 or 40, so that the lid portion 14 may be adhesively secured to the bowl portion 12 and access to the contents of the container 10 is achieved by pulling away the lid portion 14 from the bowl portion 12.

Although the invention has been described relative to a specific embodiment thereof, there are numerous variations and modifications that will be readily apparent to those skilled in the art in the light of the above teachings. For example, a number of various interlocking arrangements can be used to achieve securing the cover to the bowl either for repeatable use or for one time use. Further, in the upright position the container may be vertical, that is orthogonal to the surface upon which the container rests. It is therefore to be understood that, within the scope of the appended claims, the invention may be practiced other than as specifically described.

What is claimed is:

1. A molded bowl having a bottom and side walls defining an open top, and a peripheral portion surrounding and extending outward from said open top, said molded bowl having an integral molded foot extending outward from said side wall and away from said open top for maintaining the bowl oriented in an upright position when said integral molded foot is in contact with a horizontal surface.

2. The molded bowl of claim 1 wherein a portion of said foot intersects said side wall proximate said peripheral portion.

3. The molded bowl of claim 1 wherein said peripheral portion includes a flat segment in alignment with said foot such that in the upright position both the flat segment and the portion of said foot is in contact with the horizontal surface.

4. The molded bowl of claim 1 in which said molded bowl is maintained at an angle of about 70 to about 80 degrees when said foot is in contact with a horizontal surface.

5. A container having an opening for storing and displaying food items contained therein, the food container being operable between a horizontal position and an upright position, the container comprising in combination a molded bowl and a lid closeable over an opening in the bowl, the bowl comprising a flat bottom portion and a generally annular sidewall extending between a peripheral edge thereof and the flat bottom portion, the lid having a peripheral edge, the bowl peripheral edge and the lid peripheral edge being complementary in size and shape to provide an interference fit between the bowl and the lid, a foot integrally molded in said bowl extending rearward from the bowl sidewall, an edge of the foot being in alignment with bowl peripheral edge such that when the foot edge and bowl peripheral edge are in contact with a horizontal surface, the container is maintained in a upright position and when the flat bottom portion is in contact with a horizontal surface the container is maintained in a horizontal position.

6. The two piece container of claim 5 wherein the foot comprises a segment of the bowl sidewall and the foot edge has a length dimensioned for contact with a horizontal surface so as to maintain the container table in the upright position.

7. The food container of claim 5 wherein the bowl peripheral edge includes a flat segment in alignment with the foot edge such that when both the flat segment and the foot edge contact the horizontal surface, the food container is maintained in the upright position.

8. The food container of claim 5 wherein the bowl peripheral edge includes a first raised surface having a first wall depending from and flaring away from such first raised surface at a first angle, the peripheral complementary edge of the lid having a second raised surface with a complementary wall flaring away from such second raised surface at a second angle greater than the first angle so that urging the lid closed on the bowl provides a press fit therebetween.

* * * * *